US005592912A

United States Patent [19]

Uryu et al.

[11] Patent Number: 5,592,912

[45] Date of Patent: Jan. 14, 1997

[54] STARTER HAVING IMPROVED HEAT RADIATION

[75] Inventors: Nobuhiko Uryu; Nobuyuki Hayashi, both of Nagoya, Japan

[73] Assignee: Nippondenso Co., Ltd., Kariya, Japan

[21] Appl. No.: 405,153

[22] Filed: Mar. 16, 1995

[30] Foreign Application Priority Data

May 27, 1994 [JP] Japan ..... 6-115281

[51] Int. Cl.[6] ..... F02N 11/00

[52] U.S. Cl. ..... 123/179.25; 74/7 A; 74/7 E; 290/48

[58] Field of Search ..... 123/179.25, 179.26, 123/179.31; 290/48; 74/7 A, 7 E, 6, 7 R

[56] References Cited

U.S. PATENT DOCUMENTS

| | | | |
|---|---|---|---|
| 1,155,511 | 10/1915 | Russell | 123/179.25 |
| 2,213,374 | 9/1940 | Baker et al. | 74/7 R |
| 3,124,694 | 3/1964 | Seilly | 123/179.25 |
| 4,635,489 | 1/1987 | Imamura et al. | 74/7 E |
| 5,016,484 | 5/1991 | Morikane | 123/179.25 |
| 5,018,398 | 5/1991 | Nakagawa | 290/48 |

FOREIGN PATENT DOCUMENTS

| | | | |
|---|---|---|---|
| 56-1976 | 1/1981 | Japan . | |
| 62-32279 | 2/1987 | Japan | 290/48 |

*Primary Examiner*—Andrew M. Dolinar
*Attorney, Agent, or Firm*—Cushman, Darby & Cushman IP Group of Pillsbury Madison & Sutro LLP

[57] ABSTRACT

In a starter, to improve a heat dissipation performance, an axial length from the end of a starter housing fit into a clutch housing to a starter installation surface of the clutch housing is set to be longer than an axial length from the end of a starter motor not fit into the clutch housing to the starter installation surface. Alternatively, the exposed surface area of the starter housing fit into the clutch housing is set to be larger than the exposed surface area of the portion of the starter housing not fit into the clutch housing and the starter motor. With this configuration, the starter housing can be effectively cooled by whirling air flow in the clutch housing.

8 Claims, 4 Drawing Sheets

STARTER HAVING IMPROVED HEAT RADIATION

CROSS REFERENCE TO RELATED APPLICATION

This application is based upon and claims priority of Japanese Patent Application No. 6-115281 filed May 27, 1994, the content of which is incorporated herein by reference.

BACKGROUND OF THE INVENTION

1. Field of the Invention

The present invention generally relates to an engine starter having an outstanding heat radiation or dissipation property.

2. Related Art

In a conventional starter such as shown in FIG. 4 and FIG. 5, a starter 100 is configured of a starter housing 102 fixed on a clutch housing 101, a pinion 103 for ring gear driving provided to freely rotate and freely slide in the axial direction within the starter housing 102, a starter motor 104 that drives the pinion 103 fixed in the starter housing 102, and a magnet switch 105. The starter housing 102 is configured of a pinion storage chamber S1, and a magnet switch drive lever storage chamber S2 for pinion drive. The opening of drive lever storage chamber S2 on the axial side opposite to pinion 103 is closed off by the starter motor 104 having a built-in planetary gear or epicycle gear speed reduction mechanism.

A pinion enclosing portion 102*a* of the starter housing 102 that encloses the pinion storage chamber S1 is fit into the clutch housing 101, and the installation surface 102*a* of the starter housing 102 directly contacts the installation surface 101*s* of the clutch housing 101.

In the conventional lever drive type starter, the installation surface 102*s* is arranged on the end of the pinion enclosure portion 102*a*, and only the pinion enclosure portion 102*a* of the starter housing 102 is fit into the clutch housing 101. Furthermore with the conventional starter, the axial length L1 of the pinion enclosure portion 102*a* from the axial end of the starter housing side fit into the clutch housing 101 to the starter installation surface 101*s* of the clutch housing 101 or starter housing installation surface 102 is set to be much shorter than the axial length L3 from the end of the starter housing side not fit into the clutch housing 101 to the starter installation surface 101*s* or starter housing installation surface 102*s*.

Furthermore, the exposed surface area of the portion of the starter housing 102 fit into the clutch housing 101 is set to be much smaller than the exposed surface area of the portion of the starter housing 102 not fit into the clutch housing 101 and of the starter motor 104.

On the other hand, a heat radiation or dissipation passage in the conventional starter motor is divided into the first passage that directly radiates the heat from the outer surface of the starter motor itself, the second passage that radiates the heat to the clutch housing via the installation surface, and the third passage that radiates the heat from the starter motor to the air in the clutch housing via the starter housing pinion enclosure portion.

However, high speed, compact size and large output are required recently in starter motors, due to the incorporation of epicycle reduction gear mechanism. As a result, the heat radiation has become a problem due to the increase in the heat generated at the motor portion. It thus become necessary to increase the exposed portion of the starter housing outside the clutch housing or the surface area of the starter motor to counteract to the increased heat radiation amount of the first passage. However, as the air flow rate or speed around the starter motor is extremely small when the engine is started, the heat transfer resistance is large. The temperature of the air near the starter motor rises when heated by the starter motor, an engine block or an exhaust pipe, and thus it is difficult to greatly increase the heat radiation amount even with the increase in the surface area. In particular, when the outside temperature is high and the surface temperature of the engine or the exhaust pipe near the starter motor is kept high immediately after the engine is stopped, the heat radiation amount at the first passage drops remarkably.

On the other hand, the increase in the surface area for the installation surfaces 101*s* and 102*s* of the starter housing and clutch housing, which mutually contact, can be considered for increasing the heat radiation amount in the second passage. However, due to the size and arrangement of other devices, in particular, drive transfer mechanism such as a transmission, it is not easy to increase the radius of the installation surfaces 101*s* and 102*s*. Furthermore, immediately after the engine is stopped, etc., the engine itself is hot, causing the clutch housing temperature to also rise. Thus, there are cases when the clutch housing cannot sufficiently absorb the heat generated when the starter motor is started.

In other words, requirement of high speed and high output to conventional starter motors is limited by severe outside air conditions for cooling, temperature and flow rate, at around the periphery of the starter motor.

SUMMARY OF THE INVENTION

In view of the above problem, the present invention has a primary object to provide a starter in which the performance of increasing the heat radiation, i.e., suppressing the temperature rise, when the starter motor is started can be remarkably improved.

The present invention has another object to provide a starter that can realize an outstanding starter motor cooling function regardless of the outside air conditions, temperature and flow rate, at around the starter motor.

According to the present invention, the axial length of a starter portion, i.e., starter housing fitting portion, from the end of a starter housing to a starter installation surface in a clutch housing is set to be longer than the axial length of the starter portion from the end of a starter motor.

With this configuration, the heat generated by the starter motor is effectively radiated to the air in the clutch housing via the starter housing. This allows the temperature rise to be suppressed even under high speed operation. That is, rotary bodies such as an engine ring gear, clutch or torque converter of a transmission rotate by the drive of a crankshaft, and a high speed whirling air flow is generated in the clutch housing. The heat resistance between the starter housing fitting portion arranged to extend in the axial direction of the circumferential portion of the ring gear and the high speed whirling air flow is greatly reduced compared to the heat resistance between the outer surface of the starter motor and the outside air.

Preferably, the exposed surface area of the starter housing fitting portion is set to be larger than the sum of the exposed surface area of the starter housing non-fitting portion and the exposed surface area of the starter motor. In addition to being radiated to the inner surface of the clutch housing and ring gear surface, etc., the whirling air flow warmed by the starter housing is radiated externally from a water drain hole or ventilation hole generally formed on the clutch housing.

More preferably, a magnet switch is fixed on the starter motor or starter housing, so the starter motor can be further cooled as heat is absorbed by the magnet switch.

DETAILED DESCRIPTION OF THE EMBODIMENTS

The present invention will be described in detail with reference to presently preferred embodiments shown in the accompanying drawings.

[First Embodiment]

Figure 1:
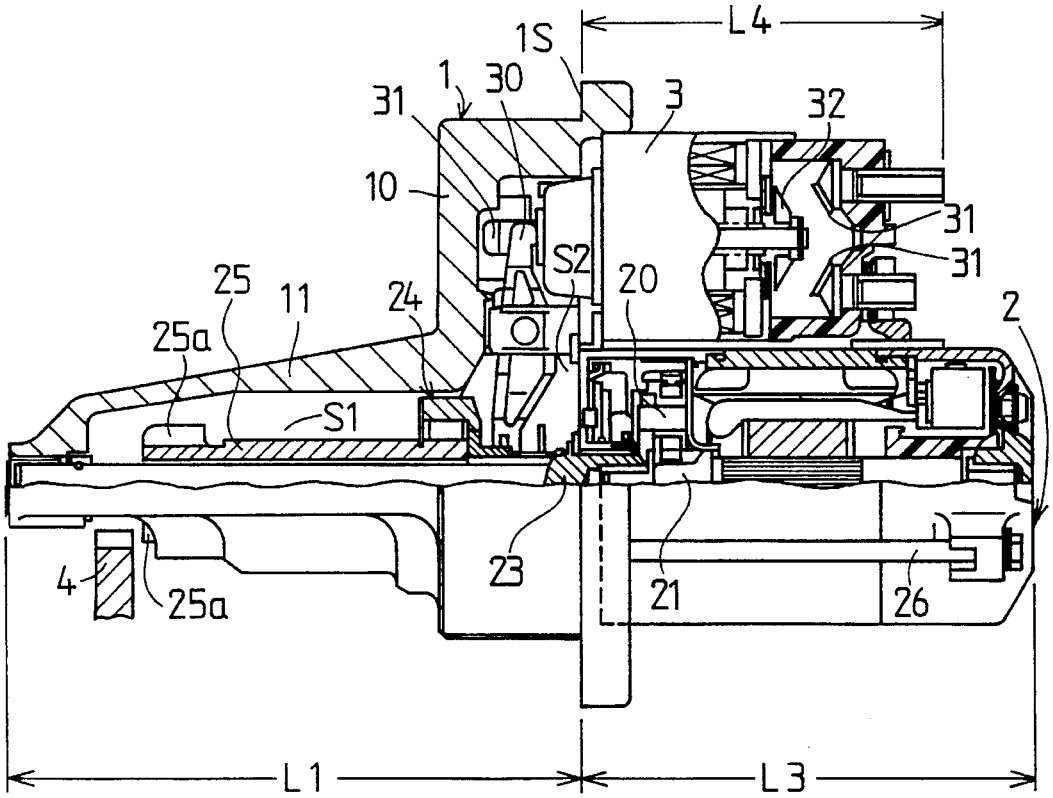
FIG. 1 is an axial cross sectional view illustrating the first embodiment of a starter according to the present invention.
Figure 1A:
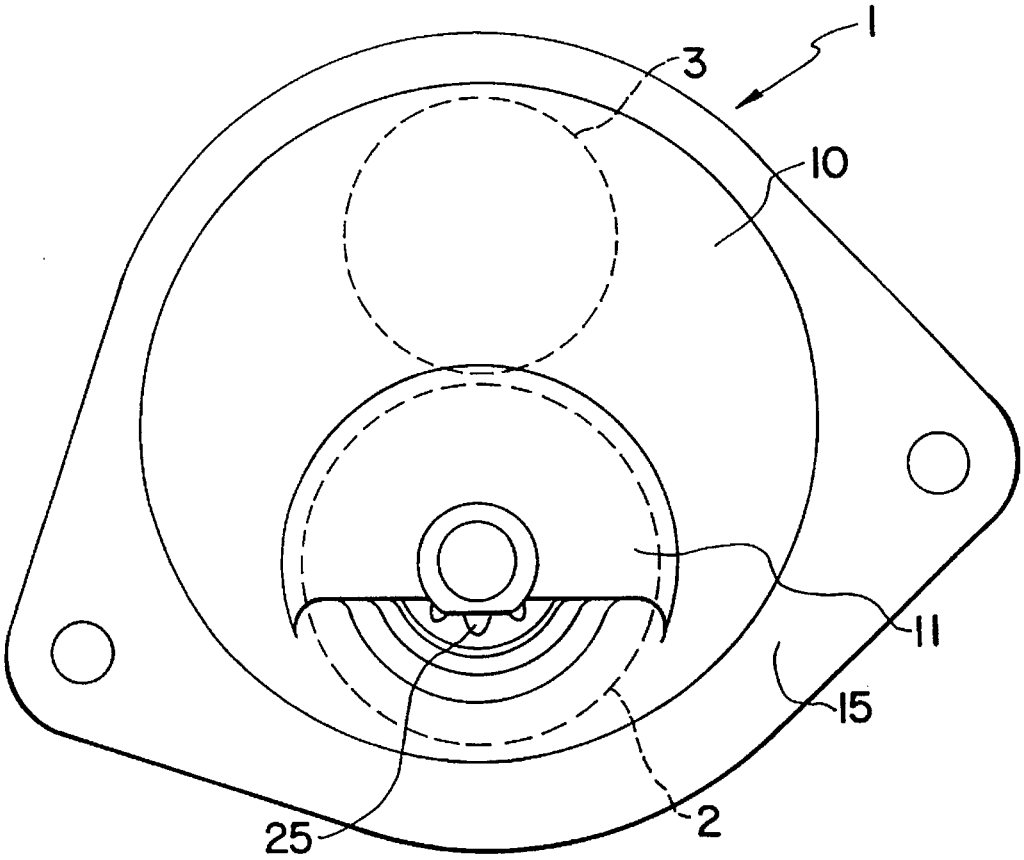
FIG. 1A is a left end view of the starter of FIG. 1.

As shown in FIG. 1 and FIG. 1A illustrating the first embodiment of a starter according to the present invention, a starter housing 1 is configured of a large diameter cylindrical base 10 having a closed bottom and a pinion enclosure portion 11 having a generally pointed cylindrical shape. A pinion storage chamber S1 is partitioned and formed in the pinion enclosure portion 11, and a drive lever storage chamber S2 is partitioned and formed in the base 10. The lower portion of the pinion enclosure portion 11 is opened outside for engagement with an engine ring gear 4, and the lower half of the rear end opening of drive lever storage chamber S2 is closed off by a starter motor 2. In other words, the front end of the starter motor 2 is fit into the lower half of the rear end opening of the drive lever storage chamber S2. In this state, the starter motor 2 is connected to the starter housing 1 with a through-bolt 26.

The upper half of the rear end opening of the drive lever storage chamber S2 is closed off by a magnet switch 3. In other words, the front end of the magnet switch 3 fixed on the upper portion of the starter motor 2 is fit into the upper half of the rear end opening of the drive lever storage chamber S2.

The starter motor 2 has a built-in planetary gear or epicycle gear speed reduction mechanism 20, and the rotation of an armature shaft 21 of the starter motor 2 is reduced in speed to drive a drive shaft 23 via the epicycle gear speed reduction mechanism 20. The front end of the drive shaft 23 is rotatably held by the front end of the pinion enclosure portion 11 in the starter housing 1, and the rear end of the drive shaft 23 is rotatably held by the front end of the armature shaft 21.

A one-way clutch 24 and an integrated pinion 25 are fit on the drive shaft 23 so that they can freely slide in the axial direction but cannot relatively rotate. Pinion gear teeth 25*a* are formed on the circumferential end surface of the cylindrical pinion 25. A drive lever 30 is held to freely move inside the starter housing 1 that faces the drive lever storage chamber S2. The drive lever 30 is driven by the axial movement of a drive shaft 31 of the magnet switch 3, and the pinion 25 is advanced and retracted in the axial direction via the one-way clutch 24. On the other hand, the ring gear 4 is arranged to face the lower opening of the pinion enclosure portion 11, and the pinion teeth 25*a* of the pinion 25 are arranged to neighbor the ring gear 4. The pinion teeth 25*a* engage and separate from the ring gear 4 with the axial direction advancement and retraction of the pinion 25.

Figure 2:
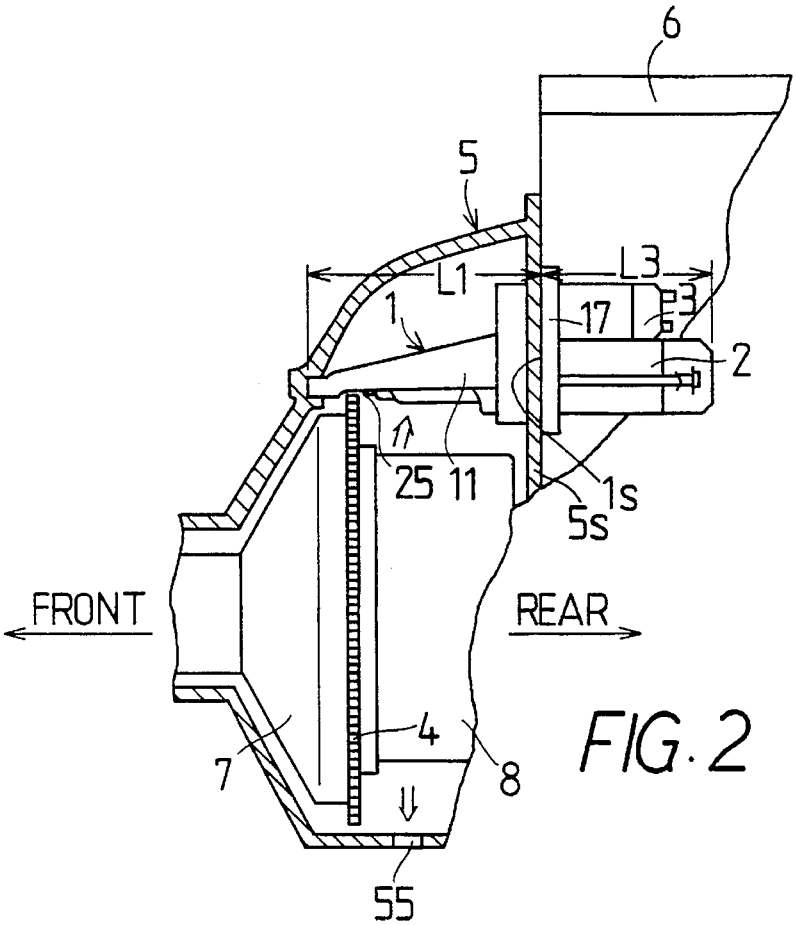
FIG. 2 is a partial cross sectional view illustrating the starter of FIG. 1 fixed to a clutch housing.

As shown in FIG. 2 illustrating the state the starter of FIG. 1 is installed on an engine, the pinion enclosure portion 11 of the starter housing 1 that encloses the pinion storage chamber S1 is fit into a clutch housing 5, and an installation surface 1*s* of the housing 1 directly contacts an installation surface 5*s* of the clutch housing 5. The end portion of the pinion enclosure portion 11 of the starter housing 1 is engaged with the inner wall surface of the clutch housing 5.

The outer flange portion 17 is formed on the periphery of the rear end opening of the starter housing 1, and the ring plate side of the outer flange portion 17 opposite the motor 2 provides the installation surface 1*s* of the starter housing 1. This contacts the installation surface 5*s* of the clutch housing 5 configured by the rear end of the clutch housing 5.

Thus, in this embodiment, the starter housing 1 is almost completely fit into the clutch housing 5 through a rear wall of the clutch housing 5. Furthermore, in this embodiment, the axial length L1 from the front end of the starter housing 1 fit into the clutch housing 5 to the installation surface 5*s* of the clutch housing 5 or installation surface 1*s* of the starter housing 1 is formed to be longer than the axial length L3 from the rear end of the starter motor 2 not fit into the clutch housing 5 to the installation surface 1*s* or 5*s*.

Of the surface area of the fitting portion of the starter housing 1 fit into the clutch housing 5, the overall surface area exposed in the space S1 in the clutch housing 5 is set to be greater than the overall exposed surface area of the portion of the starter housing 1 extending from the clutch housing 5 and of the starter motor 2 that contact the outside air.

In FIG. 2, the ring gear 4 is fixed to a casing 7, which also acts as a flywheel, and is rotatably stored in the clutch housing 5. The shaft (not illustrated) of the ring gear 4 is coupled with the crankshaft (not shown) of an engine 6 to drive an engine drive shaft (not illustrated) through a clutch mechanism and a transmission (both not illustrated) in the manner known in the art. The casings 7 and 8 designates an outer circumference of a torque converter of an automatic transmission.

The magnet switch 3 is an electromagnetically operable switch enclosing therein a fixed contact 31 and a movable contact 32 for controlling the electric connection of a battery (not illustrated) to the starter motor 2.

Other structure of the starter motor and operation of the same is also known well in the art and, hence, detailed description is omitted for brevity.

Next, the heat radiation of the starter motor 2 when the starter is started will be explained hereinunder.

The heat radiation passages of the starter motor 2 are divided into the first passage (external air heat radiation passage) that directly radiates the heat from the outer surface of the starter housing 1 exposed to the outside of the clutch housing 5 and from the outer surface of the starter motor 2, the second passage (solid heat radiation passage) that radiates the heat from the starter motor 2 to the clutch housing 5 or the magnet switch 3 via the installation surface 1*s* of the starter housing 1, and the third passage (external air heat radiation passage) that radiates the heat to the whirling air flow in the internal space between the clutch housing 5 and the starter housing 1.

As explained in this embodiment, the axial length L1 from the end of the starter housing 1 fit into the clutch housing 5 to the installation surface 5*s* of the clutch housing 5 or installation surface 1*s* of the starter housing 1 is made longer than the axial length L3 from the end of the starter motor 2 not fit into the clutch housing 5 to the installation surface 1*s* or 5*s*, so the heat radiation of the third passage (external air heat radiation passage) is remarkably improved. It is to be noted that the clutch housing 5 has a water drain hole 55 opened on the bottom base thereof and a part of the whirling air flow in the housing 5 is discharged externally from the hole 55.

Of course, by increasing the fitting percentage of the starter housing 1 into the clutch housing 5, the external surface of the starter housing 1 exposed to the outside of the clutch housing 5 is reduced thereby reducing the heat radiation in the first passage (external air heat radiation passage). However, as described above, a high speed whirling air flow is formed in the clutch housing 5 by the ring gear 4 and casings 7 and 8. Thus, if the exposed surface of the starter housing 1 exposed from the clutch housing 5 is made equal, the heat radiation amount in the third passage will become remarkably higher than that in the first passage, and the heat radiation effect will be great. Three times higher or more heat radiation effect was observed according to experiments. This is because of the difference of the inner and outer air flow rate of the clutch housing 5 when the engine is started.

Furthermore, the air around the external exposed portions of the starter motor 2 or starter housing 1 is heated by the heat generated by the starter motor 2, the engine 6 and exhaust pipes, and thus the cooling effect of the starter motor 2 may be degraded. If the external surface temperature of the engine 6 or exhaust pipe (not illustrated) near the starter motor 2 is high immediately after the engine 6 is stopped, an increase in the heat radiation amount at the first passage may be difficult. Furthermore, there may be cases where the heat radiation amount in the second passage cannot be sufficiently absorbed by the clutch housing 5 when the starter motor 2 is started because the engine itself is hot immediately after the engine is stopped causing the clutch housing 5 to be hot also.

However, in this embodiment, by drastically increasing the axial length L1 of the starter housing 1 fit into the clutch housing 5 or the exposed surface area (surface area that can contact whirling air flow in the clutch housing 5) of the starter housing 1 exposed in the clutch housing 5, the heat radiation effect is greatly improved compared to the conventional starter that depends on the heat radiation in the first and second passages. Thus, according to this embodiment, the starter may be placed at a location that adversely affects the heat radiation such as near the engine and exhaust pipe.

Furthermore in this embodiment, the axial length L4 from the rear end of the magnet switch 3 to the installation surface 1S is shorter than the axial length L1 as illustrated in FIG. 1. Thus, the heat generated when the magnet switch 3 is energized by the battery can be radiated by the third passage.

[Second Embodiment]

Figure 3:
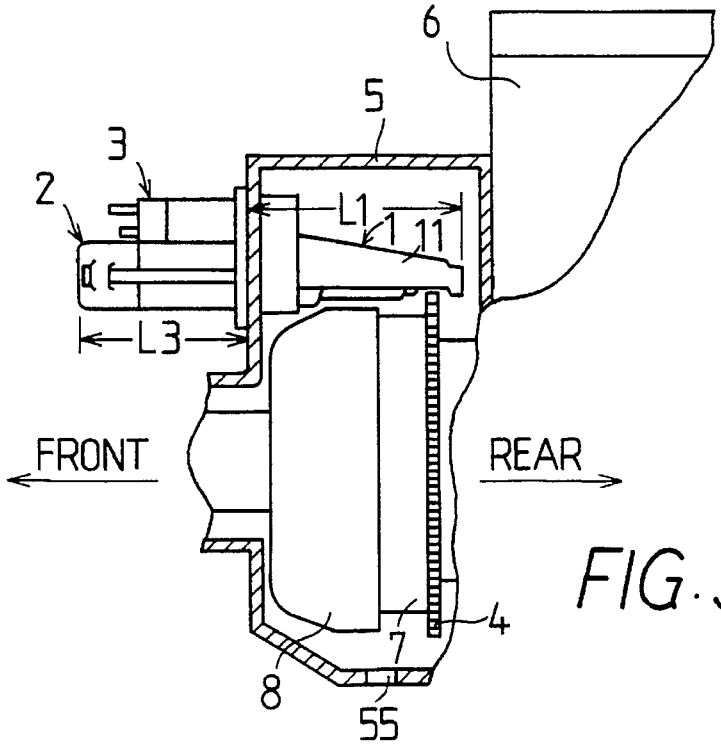
FIG. 3 is an axial cross sectional view illustrating the other embodiment of a starter according to the present invention.
Figure 4:
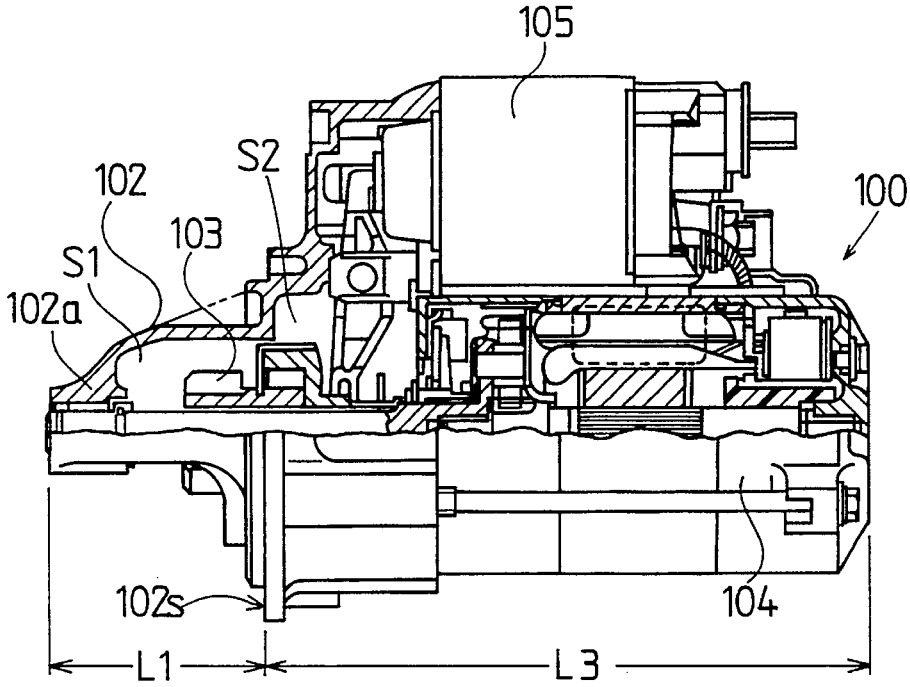
FIG. 4 PRIOR ART
FIG. 4 is an axial cross sectional view illustrating the conventional starter.
Figure 5:
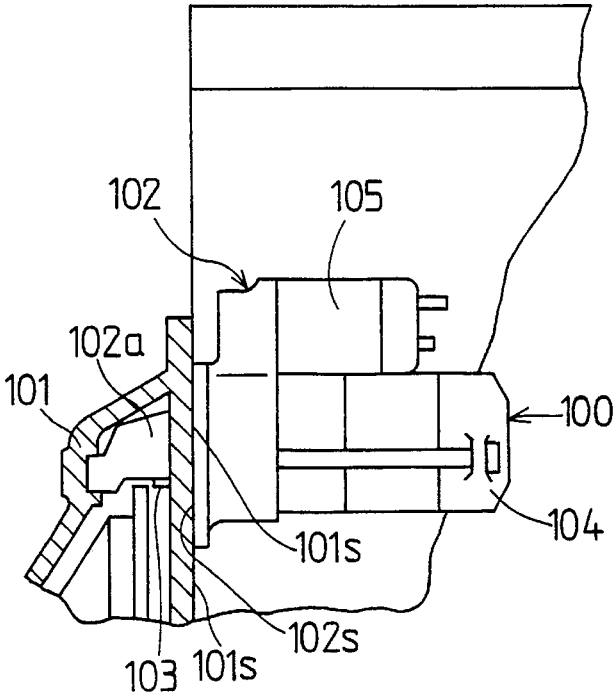
FIG. 5 PRIOR ART
FIG. 5 is a partial cross sectional view illustrating the starter of FIG. 4 fixed to a clutch housing.

The second embodiments will be described with reference to FIG. 3 in which same reference numerals are used to designate the same or like parts as in the first embodiment.

In this embodiment, the starter is fixed to the front wall of the clutch housing 5. In the clutch housing 5, the ring gear 4 is coupled with the casing 7 forming the automatic transmission torque converter so that the casings 7 and 8 rotate together with the ring gear 4. The shaft of the ring gear 4 is operatively coupled to the engine crankshaft (not illustrated) to drive the engine drive shaft (not illustrated) through the clutch mechanism and the transmission mechanism (both not illustrated).

In this embodiment, the installation surface 1*s* of the starter housing 1 is arranged at around the axial center of gravity of the entire starter. Therefore, even when only one end of the starter is supported by the clutch housing 5 as illustrated in FIG. 3, vibration, etc., can be reduced and generated noise can also be reduced. Further, the starter installation surface 1*s* can also be set on the starter motor 2 instead of the starter housing 1.

The the starter is mounted in the automobile having the automatic transmission in the above embodiments, but it may be mounted in the automobile having a manual transmission.

The present invention having been described above may be modified in many other ways without departing from the scope and spirit of the present invention.

We claim:

1. A starter for an internal combustion engine, the engine having a ring gear enclosed in a clutch housing, said starter comprising:

a starter housing having a large diameter base portion with an installation surface and a small diameter pinion enclosure portion and being constructed and arranged to be mounted to said clutch housing at said installation surface, said small diameter portion and a part of said starter housing large diameter base portion being insertable axially into said clutch housing and a remaining part of said starter housing large diameter portion being extendable from said clutch housing at a position outside thereof, said small diameter portion of said starter housing having an end surface;

a pinion supported rotatably and axially slidably in said starter housing so as to engage said ring gear of said engine; and a starter motor fitted to said remaining part of said starter housing large diameter portion for driving said pinion, said starter motor having an end surface, wherein an axial length from the end surface of said small diameter portion of said starter housing to said installation surface of said starter housing is longer than an axial length from the end surface of said motor to said installation surface so that when said starter is mounted to said clutch housing, heat generated by said starter motor is radiated to air in the clutch housing via said starter housing.

2. A starter according to claim 1, further comprising:

a magnet switch constructed and arranged to be disposed outside of said clutch housing for controlling a current flow to said starter motor.

3. A starter according to claim 1, further comprising:

a speed reduction gear mechanism disposed in said starter housing for transmitting rotation of said starter motor to said pinion at a reduced speed.

4. A starter for an internal combustion engine, the engine having a ring gear enclosed in a clutch housing, said starter comprising:

a starter housing having a large diameter base portion with an installation surface and a small diameter pinion enclosure portion and being constructed and arranged to be mounted to said clutch housing at said installation surface, said small diameter portion and a part of said starter housing large diameter base portion extending from said installation surface in one direction and being insertable into said clutch housing with a remaining part of said starter housing large diameter portion extending from said installation surface in a direction opposite said one direction and being extendable from said clutch housing at a position outside thereof;

a pinion supported rotatably and axially slidably in said starter housing so as to engage said ring gear;

a starter motor fixed to said remaining part of said starter housing large diameter portion for driving said pinion, wherein an overall surface area of said starter housing small diameter portion and said part of said starter housing large diameter portion insertable into said clutch housing is set to be greater than an overall surface area of said remaining part of said starter housing large diameter portion extendable from said clutch housing and of said motor so that when said starter is mounted to said clutch housing, heat generated by said starter motor is radiated to air in the clutch housing via said starter housing so as to suppress a rise in temperature of the starter.

5. A starter according to claim 4, further comprising:

a magnet switch constructed and arranged to be disposed outside of said clutch housing for controlling a current flow to said starter motor.

6. A starter according to claim 4, further comprising:

a speed reduction gear mechanism disposed in said starter housing for transmitting rotation of said starter motor to said pinion at a reduced speed.

7. A starter structure for an automobile having an engine, the engine having a ring gear enclosed by a clutch housing, said starter structure comprising:

a starter motor mounted outside said clutch housing and producing a rotation force when energized;

a starter housing fixedly supported in said clutch housing; and a pinion supported movably in said starter housing and operatively coupled with said starter motor to drive said ring gear, a magnet switch mounted on said starter motor outside said clutch housing;

a lever placed in said starter housing and operatively coupled to said magnet switch and said pinion for moving said pinion in response to operation of said magnet switch; and a speed reduction gear mechanism transmitting rotation of the starter motor to said pinion at a reduced speed, wherein said starter housing has an axial length and an overall surface area disposed in said clutch housing greater than an axial length and an overall surface area of said starter motor.

8. A starter for an automobile having an engine, the engine having a ring gear enclosed by a clutch housing, the starter comprising:

a starter motor adapted to be mounted outside of said clutch housing and producing rotation force when energized;

a starter housing having a portion to be fixedly supported in said clutch housing;

a pinion supported movably in said starter housing and operatively coupled with said starter motor to drive said ring gear, a magnet switch mounted in generally side-by side relation with respect to said starter motor outside of said clutch housing;

pinion transmission means operatively coupled to said magnet switch and said pinion for moving said pinion in response to operation of said magnet switch; and a speed reduction gear mechanism for transmitting rotation of said starter motor to said pinion at a reduced speed, wherein said starter housing has an axial length and a surface area greater than an axial length and a surface area of said motor so that heat generated by the starter motor is radiated to air in the clutch housing via said starter housing so as to suppress a rise in temperature of the starter.

* * * * *